US005458348A

United States Patent [19]

Lee

[11] Patent Number: 5,458,348

[45] Date of Patent: Oct. 17, 1995

[54] VENTILATING SKATE

[75] Inventor: Min-Kuo Lee, Chia Yi Hsien, Taiwan

[73] Assignee: Hi Star Co., Ltd., Chia Yi Hsien, Taiwan

[21] Appl. No.: 305,359

[22] Filed: Sep. 13, 1994

[51] Int. Cl.[6] ..... A63C 17/00; A63C 11/26

[52] U.S. Cl. ..... 280/11.19; 280/11.22; 36/3 R; 36/139; 446/26

[58] Field of Search ..... 36/134, 3 R, 3 A; 446/26, 216, 213; 280/11.22, 11.19

[56] References Cited

U.S. PATENT DOCUMENTS

| | | | |
|---|---|---|---|
| 425,368 | 4/1890 | Cole | 446/213 |
| 3,302,954 | 2/1967 | Elwell | 446/26 |
| 4,771,555 | 9/1988 | Ohashi | 36/3 R |
| 5,171,033 | 12/1992 | Olson et al. | 36/3 R |

FOREIGN PATENT DOCUMENTS

| | | | |
|---|---|---|---|
| 384884 | 4/1908 | France | 36/3 A |

*Primary Examiner*—Karin Tyson

*Attorney, Agent, or Firm*—Beveridge, DeGrandi, Weilacher & Young

[57] ABSTRACT

A ventilating skate including a skate body formed with several circular or polygonal through holes in which ventilating disks are disposed. One side of the ventilating disk is formed with a ventilating groove. A pivot plate formed with multiple through holes is rotatably connected with the ventilating disk to locate the same in the through hole of the skate body. The ventilating disk can be rotated to adjust the orientation of the ventilating groove and thus adjust the amount of incoming air. A whistling film is disposed in the ventilating groove, whereby when skating with the air passing through the ventilating groove, the whistling film is vibrated to emit a sound.

3 Claims, 4 Drawing Sheets

VENTILATING SKATE

BACKGROUND OF THE INVENTION

The present invention relates to a ventilating skate.

A conventional one-row skate is shown in FIG. 1, wherein the skate includes a skate body 11, a skate sleeve 12, a wheel support 13 and wheel members 14. The skate body 11 is formed with lace holes for a lace member 15 to pass therethrough. In addition, the skate body 11 is formed with ventilating holes 16 with various shapes so as to ventilate the interior of the skate body 11 and keep a user's foot comfortable.

The skate sleeve 12 is made of sponge and fitted in the skate body 11 to separate the user's foot from the skate body 11 and protect the user's foot. The wheel support 13 is mounted under the skate body 11 and the wheel members 14 are rotatably mounted on the wheel support 13 at equal intervals. A brake block 17 is disposed at a rear end of the wheel support 13.

Several shortcomings exist in the above skate as follows:

1. The ventilating holes of the skate body permit the interior of the skate body to communicate with the ambient environment so that the hot air inside the skate body can flow out of the skate body to avoid sweating and uncomfortable feeling of the user. However, such ventilating holes are directly formed on the skate body and cannot be closed in cold weather or at wet site. This will make the user's foot feel uncomfortable.

2. The conventional skate is provided with no other entertaining device and is monotonous.

SUMMARY OF THE INVENTION

It is therefore a primary object of the present invention to provide a ventilating skate including a skate body formed with several circular or polygonal through holes in which ventilating disks are disposed. One side of the ventilating disk is formed with a ventilating groove. A pivot plate formed with multiple through holes is rotatably connected with the ventilating disk to locate the same in the through hole of the skate body. The ventilating disk can be rotated to adjust the orientation of the ventilating groove and thus adjust the amount of incoming air or close the ventilating groove.

It is a further object of the present invention to provide the above skate in which a whistling film is disposed in the ventilating groove, whereby when skating with the air passing through the ventilating groove, the whistling film is vibrated to emit a sound and create additional entertaining effect.

The present invention can be best understood through the following description and accompanying drawings, wherein:

DETAILED DESCRIPTION OF THE PREFERRED EMBODIMENT

Figure 1:
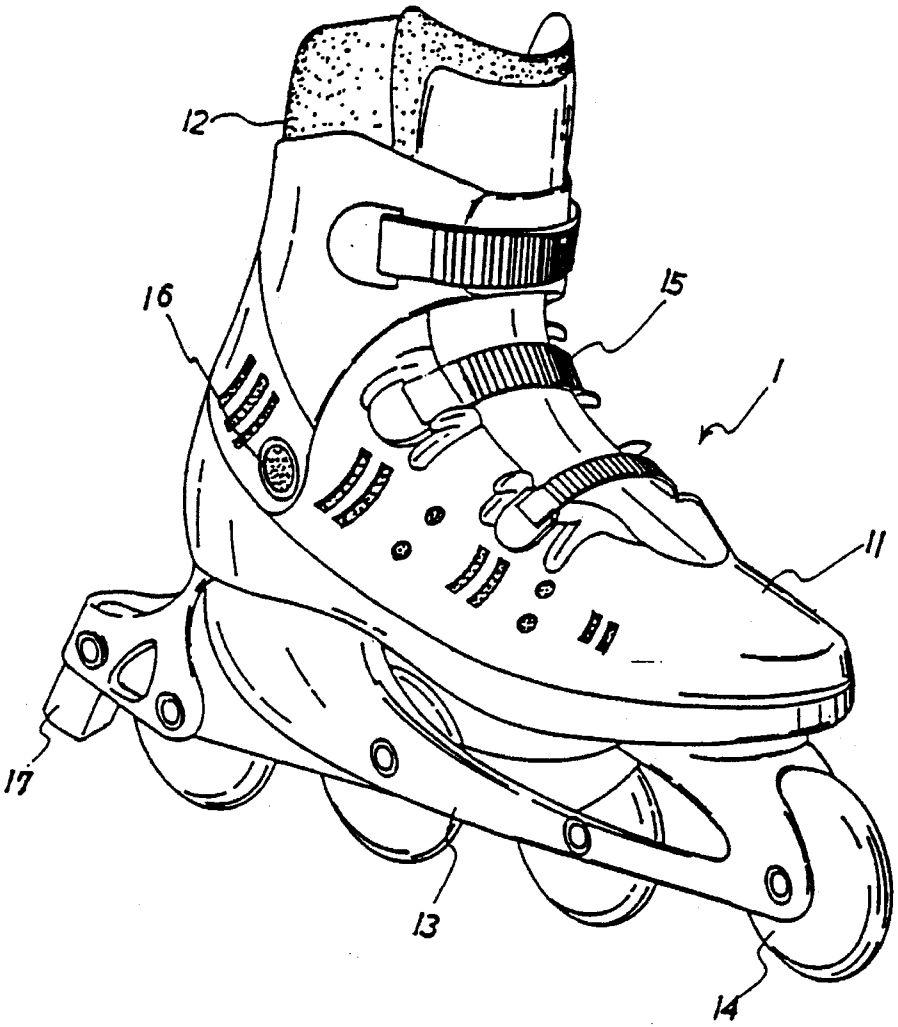
FIG. 1 (Prior Art)
FIG. 1 is a perspective view of a conventional one-row skate.
Figure 2:
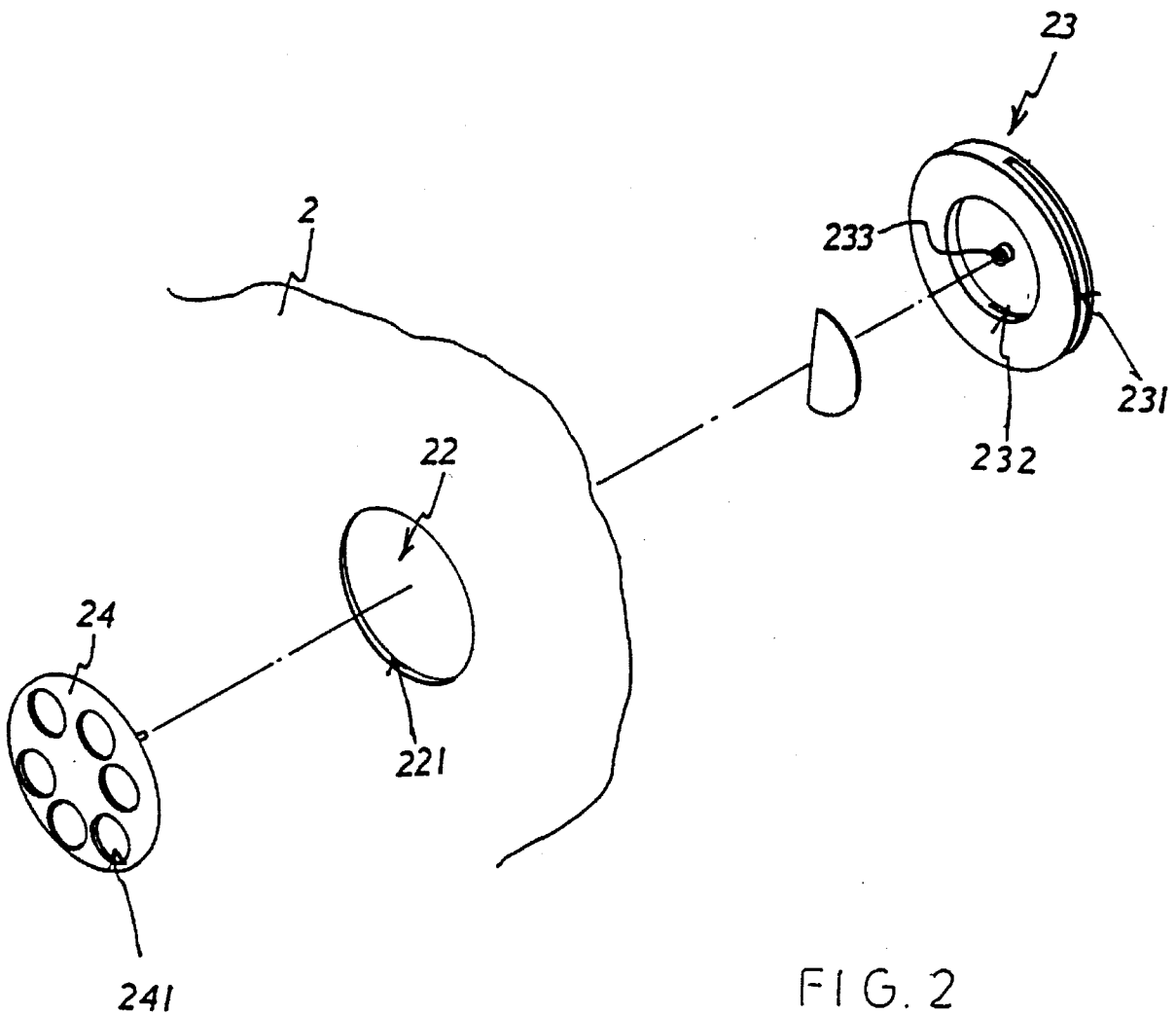
FIG. 2 is a perspective disassembled view of the present invention.
Figure 3:
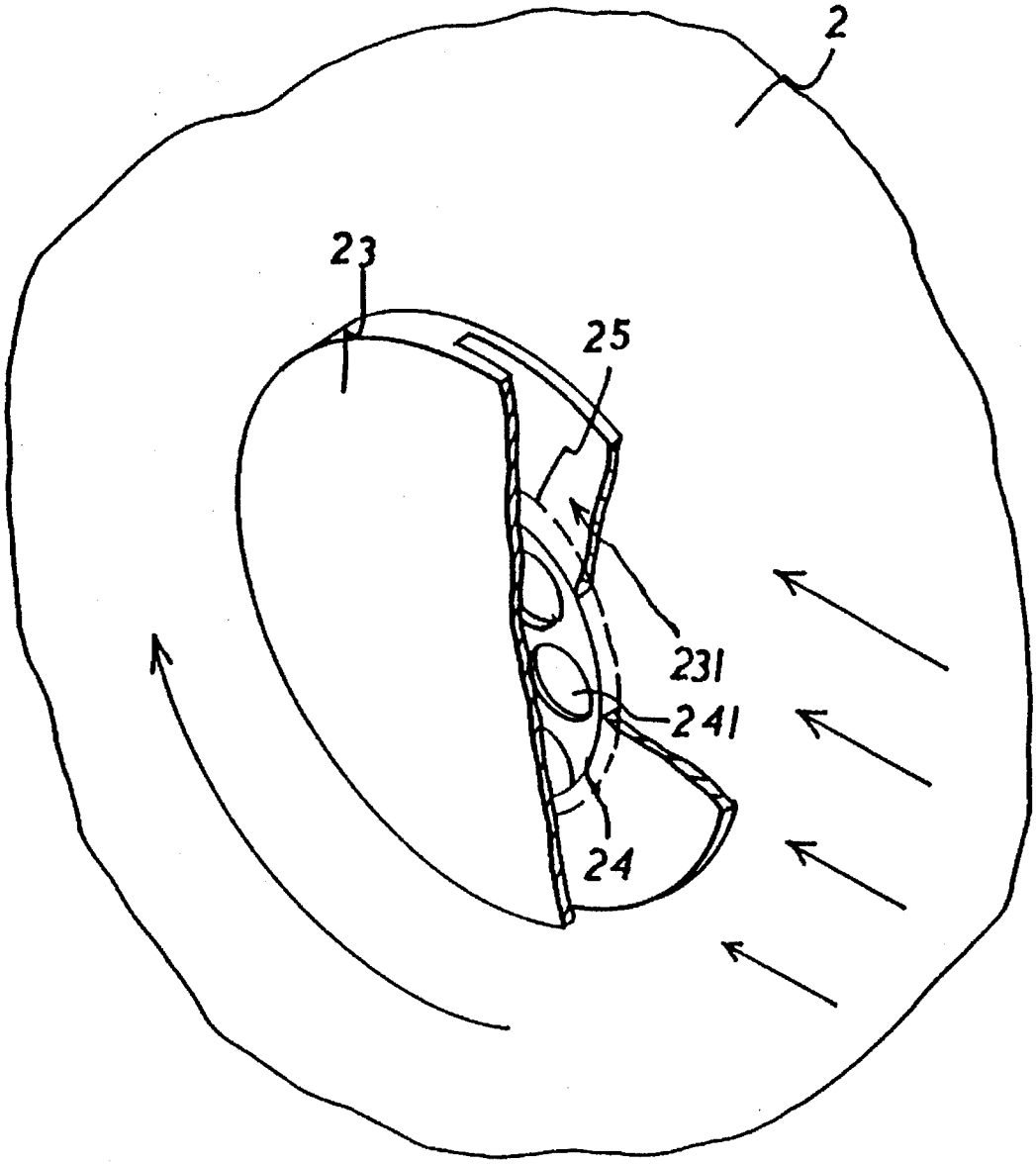
FIG. 3 shows the ventilation operation of the present invention.
Figure 4:
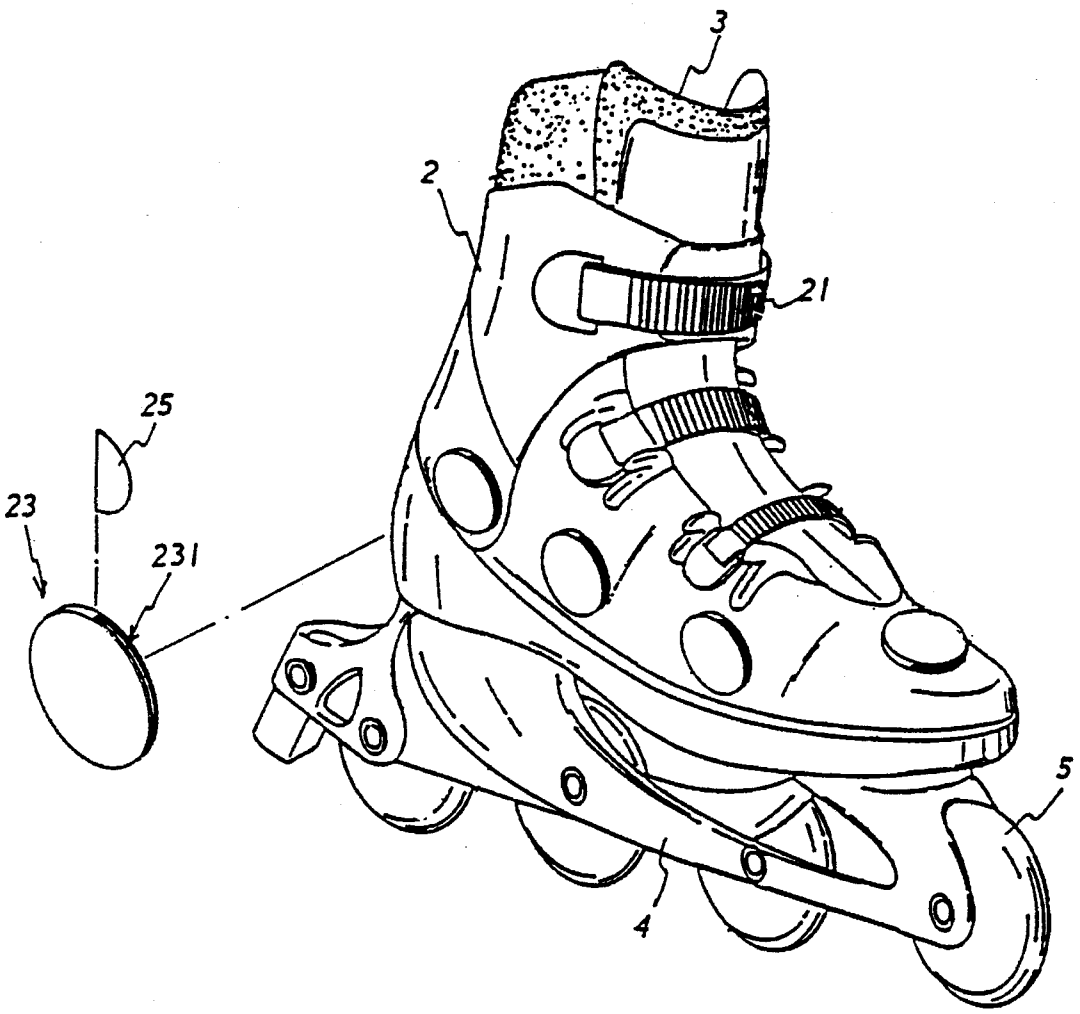
FIG. 4 shows that the present invention is applied to a one-row skate.

Please refer to FIGS. 2, 3 and 4. The ventilating skate of the present invention includes a skate body 2, a foot sleeve 3, a wheel support 4 and wheel members 5.

The skate body 2 is formed with lace holes for a lace member 21 to pass therethrough. In addition, the skate body 2 is formed with several circular or polygonal through holes 22. The outer peripheral face of each of the through holes 22 is formed with a recessed edge 221 for receiving a ventilating disk 23. One side of the ventilating disk 23 is formed with a ventilating groove 231 and an opening 232 communicating with the ventilating groove 231. A pivot hole 233 is formed above the opening 232, whereby a pivot plate 24 formed with multiple through holes 241 is rotatably connected with the ventilating disk 23. A semicircular whistling film 25 is disposed in the ventilating groove 231 to emit a sound when the air passes therethrough.

The ventilating disk 23 is disposed on outer lateral face of the skate body 2 by the pivot plate 24. The ventilating disk 23 can be rotated to make the ventilating groove 231 face forward and permit the air to pass therethrough into the opening 232 and flow through the through hole 22 of the skate body 2 and the through holes 241 of the pivot plate 24 into the interior of the skate body 2 so as to achieve ventilating effect. When the air passes through the ventilating groove 231 of the ventilating disk 23, the whistling film 25 is vibrated to emit a sound. When it is desired to prevent the air from entering the skate body 2, the ventilating disk 23 is rotated through 180 degrees to make the ventilating groove 231 face rearward. Because the ventilating disk 23 has a close side opposite to the ventilating groove 231, the air is stopped from entering the skate body 2.

Compared with the conventional device, the present invention has the following advantages:

1. The ventilating disk can be rotated to adjust the orientation of the ventilating groove so as to ventilate the skate or close the same as necessary.

2. The incoming air will vibrate the whistling film to emit a sound when skating so as to create an entertaining effect.

The above embodiment is only an example of the present invention and the scope of the present invention should not be limited to the example. Any modification or variation derived from the example should fall within the scope of the present invention.

What is claimed is:

1. A ventilating skate comprising a skate body, a foot sleeve, a wheel support and wheel members, wherein:

the foot sleeve is fitted in the skate body to separate a user's foot from the skate body and protect the user's foot;

the wheel support is fixed under the skate body and the wheel members are rotatably mounted on the wheel support; and the skate body is formed with lace holes for a lace member to pass therethrough, the skate body being formed with several through holes, an outer peripheral face of each of the through holes being formed with a recessed edge for receiving a ventilating disk, one side of the ventilating disk being formed with a ventilating groove and an opening communicating with the ventilating groove, a pivot hole being formed above the opening, whereby a pivot plate formed with multiple through holes is pivotally connected with the ventilating disk, whereby the ventilating disk can be rotated to adjust the orientation of the ventilating groove and thus adjust the amount of incoming air.

2. A ventilating skate as claimed in claim 1, wherein a whistling film is disposed in the ventilating groove, whereby when the air passes through the ventilating groove, the whistling film is vibrated to emit a sound.

3. A ventilating skate as claimed in claim 1, wherein the through hole of the skate body is circular or polygonal.

* * * * *